United States Patent [19]

Josemans et al.

[11] 4,127,754

[45] Nov. 28, 1978

[54] PIVOTING AND SLIDING CONTACTORS AND OPERATING MEMBER THEREFOR IN ELECTRIC SWITCHES

[75] Inventors: Leonardus J. Josemans, Smithfield, N.C.; John A. Swessel, Jr., Milwaukee, Wis.

[73] Assignee: Cutler-Hammer, Inc., Milwaukee, Wis.

[21] Appl. No.: 730,367

[22] Filed: Oct. 7, 1976

[51] Int. Cl.[2] ..... H01H 13/28

[52] U.S. Cl. ..... 200/67 G; 200/153 K; 200/275; 200/339

[58] Field of Search ..... 200/67 G, 67 PK, 166 BH, 200/166 BE, 276, 275, 277, 279, 68, 153 K, 167 A, 339, 335, 252, 260, 244

[56] References Cited

U.S. PATENT DOCUMENTS

| | | | |
|---|---|---|---|
| 2,926,225 | 2/1960 | Aquillon | 200/67 G |
| 2,961,505 | 11/1960 | Alio | 200/68 X |
| 2,966,560 | 12/1960 | Gluck | 200/67 G |
| 3,158,704 | 11/1964 | Sorenson | 200/67 G |
| 3,403,236 | 9/1968 | Zoludow | 200/67 G |
| 3,711,663 | 1/1973 | Sorenson | 200/67 G |
| 3,852,557 | 12/1974 | Brown | 200/67 G |
| 3,935,411 | 1/1976 | Ford | 200/67 G |

FOREIGN PATENT DOCUMENTS

| | | | |
|---|---|---|---|
| 323,744 | 8/1957 | Switzerland | 200/67 G |

*Primary Examiner*—E. A. Goldberg
*Assistant Examiner*—M. H. Paschall
*Attorney, Agent, or Firm*—Hugh R. Rather; William A. Autio; Michael E. Taken

[57] ABSTRACT

Improved pivoting and sliding contactors and an operating member for lever and rocker operated electric switches are disclosed. A resiliently pivotally mounted forked operating member engages with the contactors adjacent opposite sides thereof and pivots and slides the contactors on a common contact terminal into and out of sliding engagement with contact terminals on either side of the common terminal. Separate contactor forms for maintained ON-OFF-ON and momentary ON-ON type circuit commutations are used.

4 Claims, 6 Drawing Figures

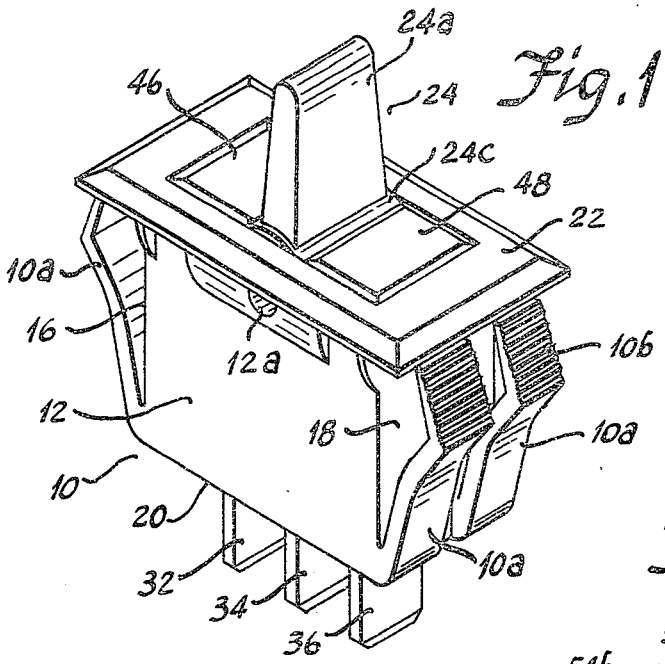
Fig. 1
Fig. 6
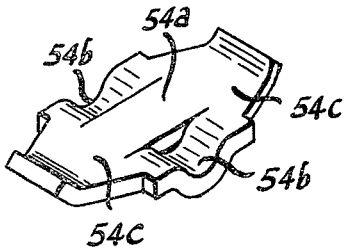
Fig. 2
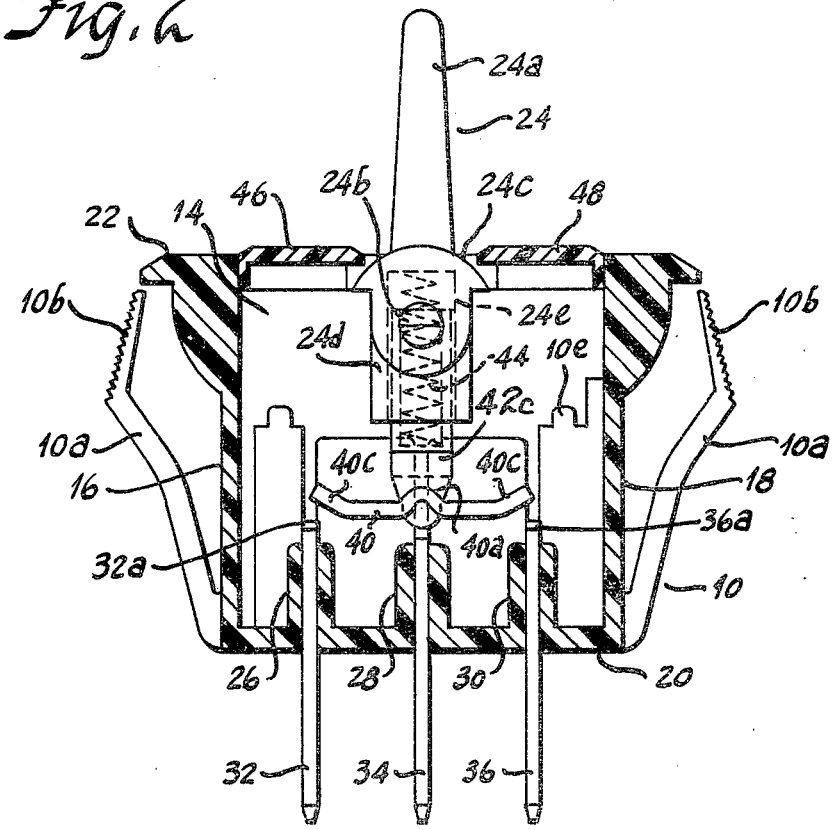

PIVOTING AND SLIDING CONTACTORS AND OPERATING MEMBER THEREFOR IN ELECTRIC SWITCHES

BACKGROUND OF THE INVENTION

U.S. Pat. Nos. 3,158,704 and 3,711,663 disclose forms of electric switches employing movable contactors that both pivot and slide on a common contact terminal into and out of sliding engagement with other contact terminals placed in one or both of opposite sides of the common terminal. The contactors of those patents are operated by operating members which pivot and engage the contactors at a single central point thereon and resiliently press them against the contact surfaces of the terminals.

OBJECTS OF THE INVENTION

It is a primary object of the present invention to provide improved form of the aforementioned type of switch contactors and an improved operating member therefor.

Another object is to provide an operating member for such contactors which engage and move them at laterally spaced apart points on the contactors to ensure maintenance of their alignment relative to the side walls of the switch housing as they are slidably moved between operating positions, and A further object is to provide forms of contactors which are particularly suited for maintained ON-OFF-ON and momentary ON-ON type of switch operations.

Other objects and advantages of the invention will hereinafter appear.

BRIEF DESCRIPTION OF THE DRAWINGS

FIG. 1 is an isometric view of a switch constructed in accordance with the invention.

FIG. 2 is a view in longitudinal cross section of the switch shown in FIG. 1.

FIG. 6 is an isometric view of a modified form of contactor used in the switch of FIG. 5.

DESCRIPTION OF THE PREFERRED EMBODIMENTS

Figure 3:
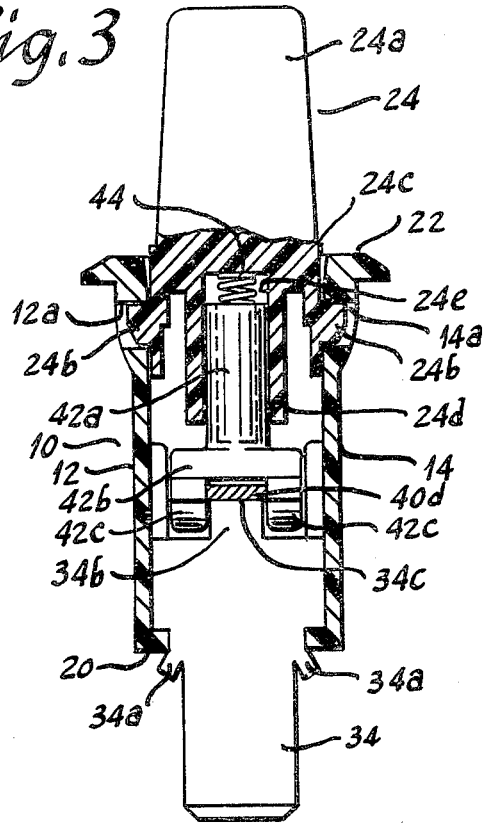
FIG. 3 is a view in transverse cross section of the switch shown in FIG. 1.

As shown in FIGS. 1 to 3, one embodiment of the switch comprises a molded housing 10 which has spaced apart side walls 12 and 14, and spaced apart end walls 16 and 18. Housing 10 is preferably formed of a suitable semi-elastic insulating material and has a rectangular bottom wall 20. An integral beveled flange 22 extends outwardly from the upper ends of the side and end walls of housing 10.

A lever operator 24 formed of a similar insulating material has a handle portion 24*a* which extends outwardly above the surface of the flange 22 as best shown in FIGS. 2 and 3, operator 24 is pivotally supported in the side walls of housing 10 by integrally formed trunnion portions 24*b* which fit into aligned apertures 12*a* and 14*a* formed in the side walls 12 and 14. Operator 24 has an integral semi-cylindrical portion 24*c* at the base of handle portion 24*a* and an integral cylindrical boss portion 24*d* which extends downwardly into the interior cavity of the housing 10.

Housing 10 has three integral spaced apart, like boss portions 26, 28 and 30 which extend upwardly from the inside of bottom wall 20. Each of the portions has a rectangular aperture extending from the inside of the housing cavity to the outer surface of the wall 20. Electrical conducting terminal members 32, 34 and 36 are seated in these apertures as best shown in FIGS. 2 and 3. The terminal members are suitably staked over against the outer surface of wall 20 as shown for terminal 34 at 34*a* in FIG. 3, to prevent inward and upward movement within base 10.

Terminals 32 and 36 are alike and have contact surfaces at their upper ends 32*a* and 36*a* which preferably are slightly convexedly laterally curved. Terminal 34 as shown in FIG. 3 is provided with a centrally located rectangular contact portion 34*b* of reduced width which at its upper flat end surface 34*c* extends above the upper end contact surfaces 32*a* and 36*a* as best shown in FIG. 2.

Figure 4:
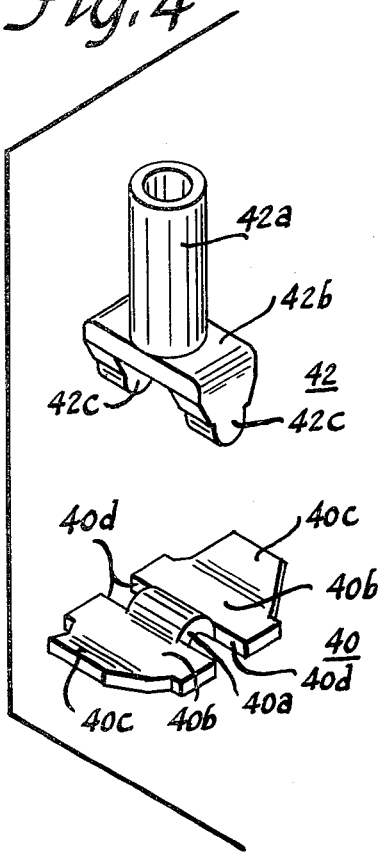
FIG. 4 is an exploded view in isometric of certain parts used in the switch of FIGS. 1 to 3.

A movable contactor 40 of the form shown in FIG. 4 and made of a good electrical conducting metal is movable within base 10 to effect electrical bridging contact between the center terminal 34 and either of the outer terminals 32 and 36. Contactor 40, which is symmetrical, has a central arcuate connecting portion 40*a* which integrally merges at opposite sides with flat portions 40*b*. The portions 40*b* in turn integrally merge with upwardly slanting portions 40*c*. The portion 40*a* extends only across approximately the central third of the portion 40*b* to thereby provide notches 40*d* on its opposite sides which lie between the portions 40*b*.

A contactor operating member 42 formed of a good electrical insulating material is adapted to move contactor 40 between the aforementioned bridging position between terminals 34 and either of the terminals 32 or 36. Member 42 is provided with a hollow cylindrical stem portion 42*a* that is slidable upwardly and downwardly in the recess 24*e* of portion 24*d* of the lever 24. A coil compression spring 44 which abuts at its upper end against lever 24 and at its lower end with the inner end wall of the stem portion 42*a* in member 42 resiliently urges the latter into engagement with the contactor 40.

Member 42 is provided with a transversely extending bridge portion 42*b* which is integrally connected midway between its ends with the lower end of stem portion 42*a*. Adjacent the ends of portion 42*b* are integral downwardly extending bosses or nibs 42*c* which engage with the spaced apart edges of the portions 40*b* of contactor 40 within the notches 40*d* thereof. As best seen in FIG. 3, the bridge portion 42*b* straddles the portion 40*a* of contactor 40 and the upper end of contact portion 34*c*.

As depicted in FIGS. 2 and 3, lever 24 is in a center position and the portion 40*a* is engaged on its lower surface with the end 34*c* of the center terminal 34. The portions 40*c* are both out of engagement with terminals 32 and 36, and the switch is thus in its "OFF" operating condition. Now assume, that lever 24 is pivoted clockwise to the right as viewed in FIG. 2. The nibs 42*c* in engagement with contactor 40 first pivot the latter to the left. Then the contactor moves upwardly on the end 34*c* so that the right hand portion 40*b* of the contactor engages on the end 34*c*. Further pivotal movement of lever 24 causes the last mentioned portion 40*b* to slide on the end 34*c* and contactor 40 continues to move leftwardly and the left hand portion 40c thereof comes into contact with the upper end 32a of the terminal 32.

As lever 24 moves toward its right hand extreme position, contactor 40 continues to slide on end 34c and engage its left hand portion 40b with the upper end 32a of terminal 32. The movement of contactor 40 from its center "OFF" position is thus initially pivotal, followed by a linear sliding movement to its electric circuit completing position astride and biased downwardly against the ends 32a and 34c of terminals 32 and 34.

Movement of lever 24 back to its center position from its aforementioned right hand operating position first slides contactor 40 to the right on the ends of terminals 32 and 34. When lever 24 reaches its center positive of FIG. 2, the lower concaved surface of the portion 40a engages on the end 34c of terminal 34 and contactor 40 then resumes its "OFF" circuit position depicted in FIG. 2.

It will be apparent that if lever 24 is pivoted counterclockwise to the left as viewed in FIG. 2, contactor 40 will be moved in a similar manner to that aforedescribed to the right to be brought into a bridging electrical circuit maintaining contact with ends 34c and 36a of terminals 34 and 36. Likewise movement of lever 24 back to its center position will effect movement of contactor 40 to the left to its "OFF" circuit position depicted in FIG. 2.

Housing 10 is provided with a pair of integral spaced apart and upwardly and outwardly extending arms 10a on each end thereof. These arms are proportioned so that they can be flexed. Adjacent their ends along their outer surface the arms 10a are provided with a series of closely spaced notches or serrations 10b. When the switch is inserted downward through an appropriately sized rectangular opening in a panel, the arms 10a flex inwardly toward the body, and snap outwardly to engage along their serrated portions 10b with the inner surface of the panel when the flange 22 engages the upper surface thereof. Such switch mounting and retaining arms are well known and do not form part of the present invention.

Snap-in insert pieces 46 and 48 formed of a molded semi-elastic insulating material like that from which housing 10 is formed, are emplaced on opposite sides of the lever 24. These inserts partially overlie the intermediate cylindrical portion 24c of lever 24 to provide substantial closure for the upper side of the switch.

Figure 5:
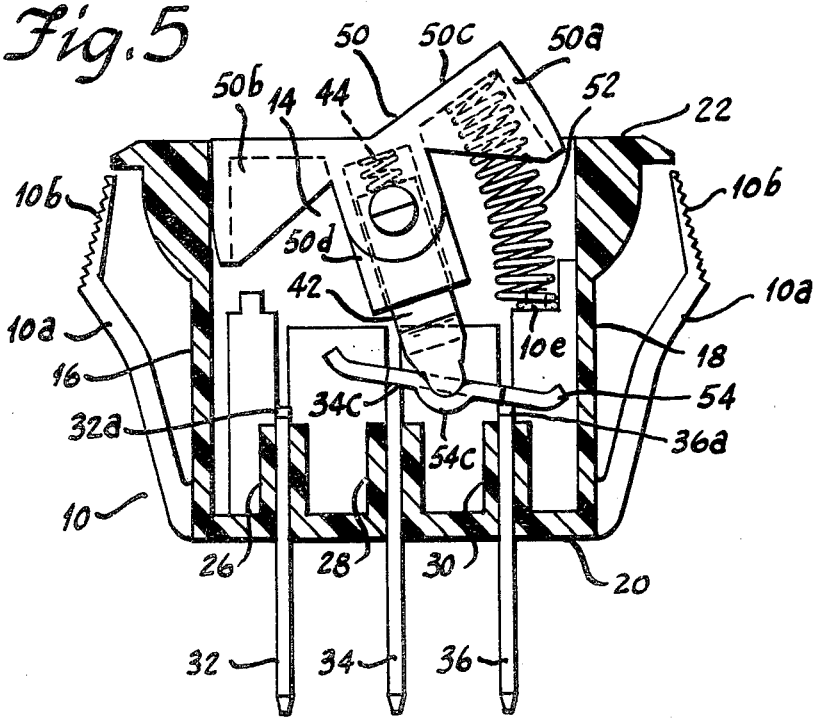
FIG. 5 is a view in longitudinal cross section of a modified form of switch.

FIG. 5 shows a modified form of switch unit which employes a housing 10 like that aforedescribed in conjunction with FIGS. 1 to 3. However, this form of switch employs a rocker type actuator 50 in place of the lever 24. The rocker 50 has like, right and left portions 50a and 50b which has upper flat surfaces 50c which meet and define a shallow V-shaped angle. It also has a stem portion 50d which is like the corresponding stem portion 24d of lever 24.

A compression spring 52 is anchored around an upstanding boss 10e formed in base 10 and engages rocker 50 on the lower surface of its portion 50a. Spring 52 normally serves to pivot rocker 50 to a counterclockwise extreme position wherein it holds operating member 42 and a contactor 54 in the positions shown in FIG. 5 in which the latter bridges the contact ends of terminals 34 and 36 to provide a continuous electric circuit therebetween.

Contactor 54 is of the modified form shown in FIGS. 5 and 6. It comprises a central generally flat portion 54a in which are formed laterally spaced apart arcuate depressions 54b and portions 54c which are generally trapezoidal in plan which extend oppositely from the portion 54a. The portions 54c are bent at an angle upwardly adjacent their free ends. The nibs 42b of operating member 42 engage contactor 54 within the depressions 54c and are adapted to move contactor 54 to the left upon clockwise depression of rocker 50.

When rocker 50 is depressed against the opposing bias of spring 52, it will be observed that contactor 54 first slides leftwardly on its portion 54a and right hand portion 54c on the ends of terminals 34 and 36. When the ends of the nibs 42c reach a position slightly beyond and to the left of the end 34c of terminal 34 the contactor 54 becomes disengaged from the end of terminal 36 and is pivoted counterclockwise into engagement with the end of terminal 32. Contactor 54 thereafter slides leftwardly on the ends of terminals 32 and 34 to a position which corresponds with the extent of depression of rocker 50 in the clockwise direction. The downward bias of the spring 44 exerted through member 42 on contactor 54 assures that good electrical contact is maintained with the ends of the stationary terminals during the course of movement of the contactor.

It will be apparent that when rocker 50 is thereafter released, the bias of the stored energy in spring 52 causes rocker 50 and operating member 42 to pivot counterclockwise. This effects movement of contactor 54 to the right as viewed in FIG. 5 in the reverse order first described to effect the final position of the contactor on the ends of terminals 34 and 36 shown.

We claim:

1. In an electric switch, in combination:

a housing;

a pair of contact terminals spaced apart in said housing;

a third terminal mounted between said contact terminals in said housing, said third terminal having a contact portion centrally located and substantially narrower in width than the remainder of that terminal and extending above the corresponding ends of said contact terminals;

a movable contactor of a width greater than said contact portion of said third terminal cooperating with said terminals to complete electrical circuits between said contact portion of third terminal and either of said contact terminals;

an operator pivotally mounted in said housing, and having a portion exteriorally thereof which is engageable to effect pivoting thereof;

a contactor operating member within said housing and having a central stem portion in resilient engagement with said operator and laterally spaced apart portions connected with said stem portion, said contactor having means formed therein on opposite sides of said contact portion of said third terminal to receive and continuously seat complementally formed ends of said spaced apart portions of said contactor operating member while affording free pivoting of the latter therein, and said operating member being pivotally movable by said operator to pivot said contactor on the contact portion of said third terminal and to slide it thereon into engagement with either of said contact terminals.

2. The combination in an electric switch as defined in claim 1, wherein said contactor operating member has its central stem portion slidably mounted in a complemental formed portion of said operator, wherein said operating member has a bridge portion extending in opposite directions from said stem portion and straddling the end of said contact portion of said third terminal, wherein said spaced apart portions of said bridge portion have rounded ends which are in said seated and pivotal engagement within said means of said contactor, and wherein a compression spring interfitting with said stem portion of said operator resiliently urges said operating member into such engagement within said means of said contactor and the latter into engagement with said terminals in accordance with positioning of said contactor thereon.

3. The combination in an electric switch as defined in claim 1 wherein said contactor has spaced apart notches therein into which said ends of said spaced apart portions of said operating member extend and have said seated and pivotal engagement with said contactor, and wherein said contactor has an arcuately curved portion between said notches which engages on its concaved surface with the contact portion of said third terminal when said operator is in a center position in said housing to hold said contactor out of engagement with both of said pair of contact terminals.

4. The combination in an electric switch as defined in claim 1 wherein said contactor has laterally spaced apart concave arcuate recesses within which said complementally formed ends of said spaced apart portions of said operating member seat and pivot to move said contactor, and wherein said contactor has a flat portion between said recesses which engages with the contact portions of said third and said pair of contact terminals.

* * * * *